US006543949B1

(12) United States Patent
Ritchey et al.

(10) Patent No.: US 6,543,949 B1
(45) Date of Patent: Apr. 8, 2003

(54) KEYBOARD SUPPORT APPARATUS

(76) Inventors: Eugene B. Ritchey, 13821 Sable Blvd., Brighton, CO (US) 80601; Craig E. Ritchey, 14031 Sable Blvd., Brighton, CO (US) 80601

( * ) Notice: Subject to any disclaimer, the term of this patent is extended or adjusted under 35 U.S.C. 154(b) by 0 days.

(21) Appl. No.: 09/533,329

(22) Filed: Mar. 23, 2000

(51) Int. Cl.[7] ..... B41J 3/39
(52) U.S. Cl. ..... 400/691; 400/693
(58) Field of Search ..... 400/691, 693, 400/715, 472; 248/118.1, 118.3, 918; 341/22; 312/208.1, 208.4

(56) References Cited

U.S. PATENT DOCUMENTS

| | | | | |
|---|---|---|---|---|
| 669,009 A | | 2/1901 | Ingraham | |
| 2,224,530 A | | 12/1940 | Weinstein | 45/80 |
| 2,374,409 A | | 4/1945 | Brennan | 45/80 |
| 3,300,250 A | | 1/1967 | Dollgener et al. | 297/411 |
| 4,044,980 A | | 8/1977 | Cummins | 248/13 |
| 4,460,146 A | | 7/1984 | Raggiotti | 248/456 |
| 4,467,727 A | * | 8/1984 | Strommer | 101/23 |
| 4,618,119 A | * | 10/1986 | Powell | 248/456 |
| 5,135,190 A | | 8/1992 | Wilson | 248/118.1 |
| 5,145,270 A | | 9/1992 | Darden | 400/488 |
| 5,170,971 A | | 12/1992 | Schaeffer et al. | 248/118.1 |
| 5,244,296 A | | 9/1993 | Jensen | 400/715 |
| 5,292,097 A | | 3/1994 | Russell | 248/281.1 |
| 5,375,800 A | | 12/1994 | Wilcox et al. | 248/118.1 |
| 5,464,292 A | | 11/1995 | Grant | 400/715 |
| 5,492,291 A | | 2/1996 | Otani | 248/118.1 |
| 5,513,824 A | | 5/1996 | Leavitt et al. | 248/118.3 |
| 5,567,067 A | | 10/1996 | Ambrose | 400/472 |
| 5,582,375 A | | 12/1996 | Martin | 248/118.3 |
| 5,628,483 A | | 5/1997 | Smith et al. | 248/118 |
| D391,941 S | | 3/1998 | Brunner | D14/114 |
| 5,775,657 A | | 7/1998 | Hung | 248/289.11 |
| 5,826,992 A | | 10/1998 | Camacho et al. | 400/489 |
| 5,833,378 A | | 11/1998 | Gibson | 400/472 |
| 5,881,984 A | | 3/1999 | Lin | 248/284.1 |

FOREIGN PATENT DOCUMENTS

WO PCT WO 98/23185 * 6/1998

OTHER PUBLICATIONS

Reliable Office Supplies, Product Catalog, pp279–281, total of five pages, including front cover and back cover.

* cited by examiner

*Primary Examiner*—Anthony H. Nguyen
(74) *Attorney, Agent, or Firm*—Sheridan Ross P.C.

(57) ABSTRACT

A keyboard support apparatus is provided to allow a keyboard to be placed in a reverse inclination or angle thus allowing a user's hands and fingers to be placed at a level at or below the level of the user's forearms and wrists when the user's forearms are extended for keyboarding operations. A first embodiment includes an inclined panel rotatably connected to a base panel, and an adjustment panel which has a free end for engaging adjustment slots in the base panel thereby allowing a selective inclinations of the inclined panel with respect to the base panel. In a second embodiment, the keyboard support apparatus may be used in conjunction with a common computer desk or table which incorporates a pull-out tray. The keyboard support apparatus is installed on the pull-out tray allowing a user to adjust the reverse inclination of the keyboard, or to allow the keyboard to remain in its normal horizontal position.

11 Claims, 3 Drawing Sheets

KEYBOARD SUPPORT APPARATUS

TECHNICAL FIELD

This invention relates to a keyboard support apparatus, and more particularly, to a support apparatus to support a keyboard at a reverse inclination or angle to help prevent afflictions such as carpal tunnel syndrome experienced by keyboard operators.

BACKGROUND ART

Alphanumeric keyboards used in typewriters, computers, and in certain scientific instruments are most often arranged such that the front edge of the keyboard surface is lower than the rear edge of the keyboard surface. Accordingly, a keyboard operator must elevate the hands with respect to the forearms in order to strike the keys. The medical community has become aware of an affliction known as "carpal tunnel syndrome" which effects the median nerve extending down the arm and out to the hand. This median nerve can be exacerbated by repetitive keyboard operation wherein the hands are elevated in comparison to the forearms.

In order to overcome this undesirable affliction, it is known to provide a keyboard support at a reverse angle or inclination such that the hand and fingers are allowed to droop normally at a level parallel with or somewhat below the forearms. Performing keyboard operations while the hands are in this position can help to prevent carpal tunnel syndrome. One example of a prior art reference which discloses such a reverse angled keyboard support apparatus includes U.S. Pat. No. 5,567,067. This invention discloses a keyboard positioning system in which the keyboard is positioned with its rear edge substantially lower than its forward or operator edge in order that the operator uses the keyboard with the plane of the operator's hands parallel to, or below the line of the operator's forearm, thus reducing the incidence of carpal tunnel syndrome. A hand support bar is provided to support the operator's hands while keyboarding.

Another example of a keyboard support device utilizing a reverse inclination is that shown in U.S. Pat. No. 5,833,378. This reference discloses a keyboard support tray having folding legs. The legs have risers to enable adjustment of a support deck to a height so that a hinged tray depends at an approximate negative angle of 25°. The support deck has a height to support a wrist pad at just below the user's wrists to enable typing with a 0° angle from the wrist to the forearm.

While these inventions may help to overcome carpal tunnel syndrome, each of the foregoing inventions are fairly complex, and do not provide a completely foldable keyboard support which can be easily carried within a small carrying case, such as a laptop computer case. Furthermore, the means to adjust the inclination of the keyboard support require at least two separate points of adjustment in order to obtain the desired inclination.

According to the present invention, in a first embodiment, one object is to provide a structurally strong yet simple keyboard support apparatus which may be folded and carried in a standard laptop computer case, or in some other small piece of luggage. Another object of this invention is to provide, in a second embodiment, a keyboard support apparatus that is used in conjunction with a standard computer desk which includes a pull-out tray for supporting a keyboard.

SUMMARY OF THE INVENTION

The invention is a keyboard support apparatus which provides a reverse inclination or angle such that a user's hands are kept parallel with the forearms or can be bent at a slight downward angle to help prevent afflictions such as carpal tunnel syndrome which are exacerbated by having to raise the hands above the plane of the forearms. In its simplest form, in the first embodiment, the keyboard support apparatus includes a base panel, an inclined panel, and means for adjusting the incline of the inclined panel with respect to the base panel. The base panel and the inclined panel are connected by a living hinge which may be made of the same material as the base and inclined panels. The adjustment means includes an adjustment panel which is connected to the other end of the inclined panel by another living hinge. The base panel has an upper surface which includes a plurality of adjustment slots or ribs. The free end of the adjustment panel is placed within a desired adjustment slot, thus allowing the inclined panel to be positioned at the desired reverse inclination. A keyboard is secured on the inclined panel such that the front or forward edge of the keyboard is elevated in comparison to the rear or far edge of the keyboard. A wrist pad may be placed between the inclined panel and adjustment panel along the living hinge. The keyboard support apparatus may be completely folded such that the adjustment panel and base panel overlie the inclined panel. In this compact state, the keyboard support apparatus may be stored within a laptop computer case, or other small piece of luggage. In use, the keyboard support apparatus is assembled simply by rotating the inclined panel back over the base panel, and then rotating the adjustment panel for placement of the free end thereof within the desired adjustment slot of the base panel.

The first embodiment may be constructed of a single sheet of plastic material which is molded into shape according to well-known molding or injection molding techniques. The living hinges are formed simply by creating narrowed or thinner sections which extend along the desired lines to form the hinges. Similarly, the adjustment slots may be formed by the molding process by providing a mold having a shape corresponding to the adjustment slots.

In a modified form of the first embodiment, a rigid keyboard support apparatus may be provided which is not adjustable and cannot be folded; however, this rigid embodiment is even more easy to manufacture because of its simple molded shape. In yet another modification of the first embodiment, the keyboard support apparatus may be defined as two distinct keyboard support elements interconnected by a wrist pad. The two keyboard support elements comprising the keyboard support apparatus are collectively smaller in size than the larger continuous keyboard support apparatus and therefore, are even more easily transported. A well-known snap fitting or other means may be used to secure the wrist pad between the keyboard support elements. For example, each end of the wrist pad and the corresponding contact surfaces of the keyboard support elements may be equipped with hook and pile material (i.e., Velcro®).

In a second embodiment of the invention, a keyboard support apparatus is used in conjunction with a computer desk having a pull-out tray. Many computer desks or computer stations include the use of a pull-out tray which supports the keyboard. According to the second embodiment, the desired reverse inclination or angle of the keyboard may be achieved by use of a base member which is hinged to the pull-out tray at one end, and has an opposite end which is free to swing downwardly, to engage an angle adjustment member having a plurality of adjustment slots. One or more leaf springs are used to urge the base member to the horizontal position. Thus, when the keyboard operator has completed the keyboard operations, the angle adjustment member may be disengaged from the free end of the base member allowing the keyboard to be raised back to the horizontal position.

These and other advantages of the invention will become apparent to one skilled in the art in a review of the following description of the invention, taken in conjunction with the drawings and the claims.

DETAILED DESCRIPTION OF THE DRAWINGS

Figure 1:
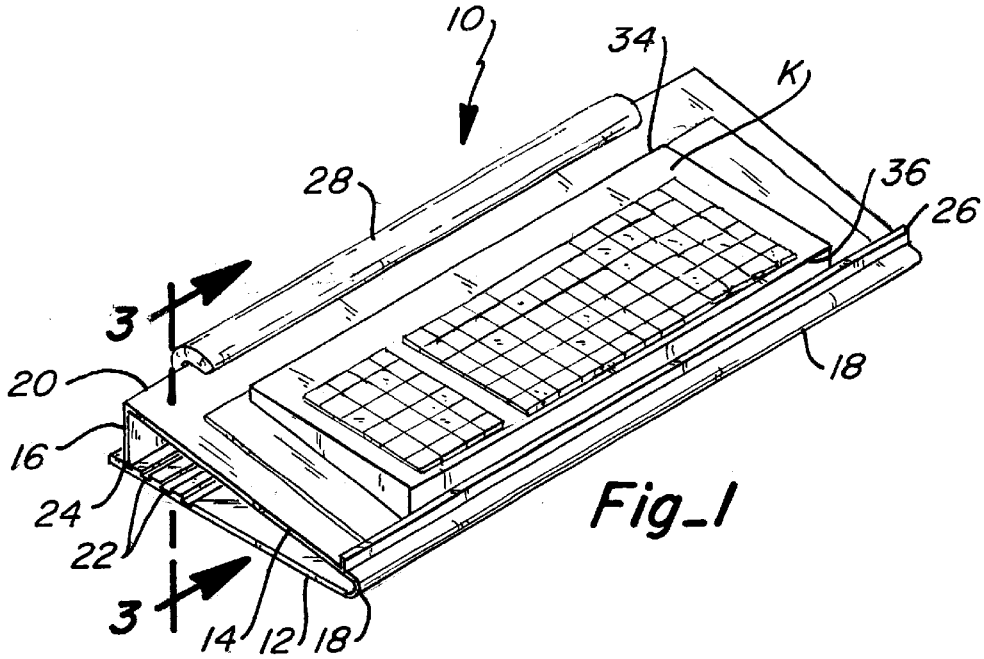
FIG. 1 is a perspective view of a first embodiment of the keyboard support apparatus of this invention.
Figure 2:
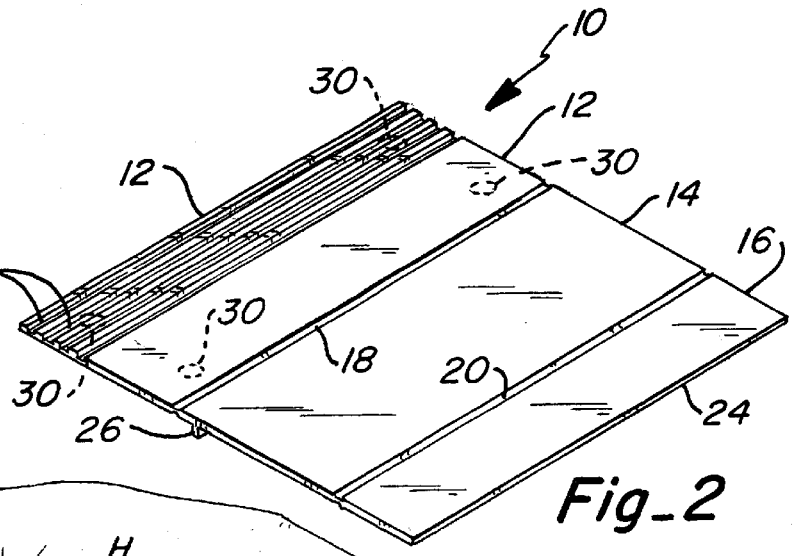
FIG. 2 is another perspective view of the first embodiment; however, the keyboard support apparatus has been unfolded and the wrist pad has been removed.
Figure 3:
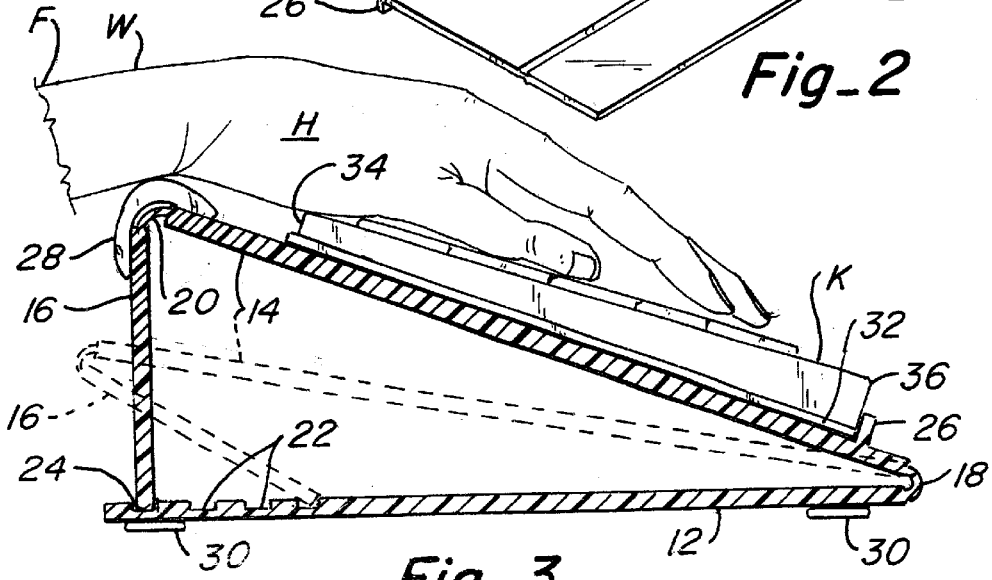
FIG. 3 is vertical section, taken along line 3—3 of FIG. 1, showing a keyboard mounted on the keyboard support apparatus, and the hand of a keyboard operator wherein the hands and fingers of the operator are allowed to extend parallel with the plane of the forearm, or at a slight downward inclination.

According to the first embodiment as shown in FIG. 1, the keyboard support apparatus 10 comprises three major elements, namely, a base panel 12, an inclined panel 14, and an adjustment or positioning panel 16. Base panel 12 is interconnected to the inclined panel 14 as by first living hinge 18. The inclined panel 14 is connected to the adjustment panel 16 by second living hinge 20. One surface of the base panel 12 includes a plurality of adjustment slots 22. In operation, the free end 24 of adjustment panel 16 is placed within the desired adjustment slot 22, thus providing the inclined panel 14 with the desired reverse inclination or angle. The keyboard K is supported on the upper surface of the inclined panel 14. A stop 26 may extend adjacent the first living hinge 18, thus preventing the keyboard K from sliding off the inclined panel 14. A wrist pad 28 may be removably secured between the inclined panel 14 and adjustment panel 16 along second living hinge 20. As seen in FIG. 3, the keyboard support apparatus may further include a plurality of rubber feet 30 which attach to the lower or bottom surface of the base panel 12. Furthermore, a non-skid surface 32 may be bonded to the upper surface of the inclined panel 14 to help stabilize the keyboard K mounted thereon. As shown in FIG. 2, the apparatus is easily dissembled. First, the keyboard is removed along with the wrist pad. Then, the apparatus is simply unfolded by removing the free end 24 from within the adjustment slot 22 and rotating the free end 24 clockwise (from the view of FIG. 3) so that the keyboard support apparatus is flat, as shown in FIG. 2. Then, the base panel 12 and adjustment panel 16 are simply folded over the inclined panel 14 (not shown). The keyboard support apparatus may then be easily stored within a small piece of luggage or a laptop computer case. Although FIG. 1 illustrates the keyboard support apparatus extending beyond the length of the keyboard, it shall be understood that the keyboard support apparatus can be fashioned in any desired length such that the particular keyboard being used has adequate support. As shown in FIG. 3, the user's hands H are placed at an angle which is parallel with or at a slight reverse angle, with respect to the user's wrists W and forearms F. The reverse inclination of the keyboard support apparatus thereby helps to prevent carpal tunnel syndrome and other related afflictions caused by the hands H being placed at a positive or upward angle with respect to the wrists W and the forearms F. The rear edge 36 of the keyboard is placed at a desired level lower than the front edge 34 of the keyboard. As is also shown in FIG. 3, in dashed lines, the reverse inclination of the inclined panel 14 can be reduced by placing the free end 24 in a more rearward adjustment slot 22.

Figure 4:
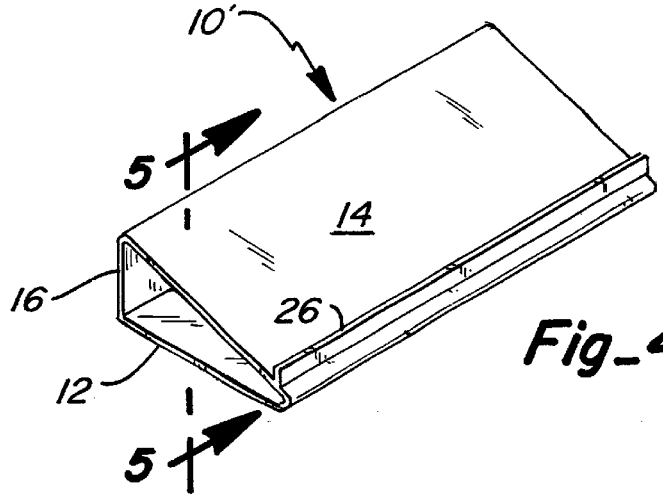
FIG. 4 is a perspective view of a modification of the first embodiment.
Figure 5:
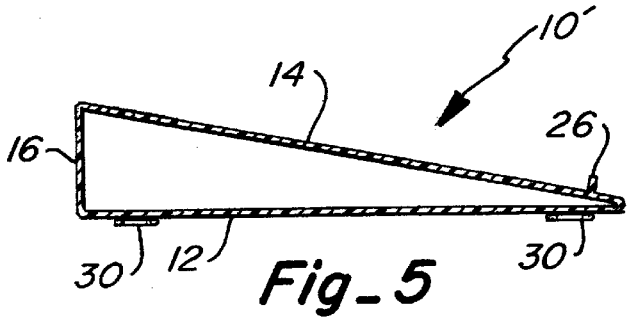
FIG. 5 is a vertical section, taken along line 5—5 of FIG. 4.

FIG. 4 illustrates a modification to the first embodiment, in the form of keyboard support apparatus 10'. As shown, this apparatus is the same keyboard support 10; however, the living hinges and the adjustment capability are eliminated in favor of a non-collapsible rigid connection. Although this embodiment does not allow the device to be folded, nor does it allow angle adjustment, it is very easily manufactured in a simple molding process. Therefore, there are advantages in this modified embodiment in terms of manufacturing costs and simplicity.

Figure 6:
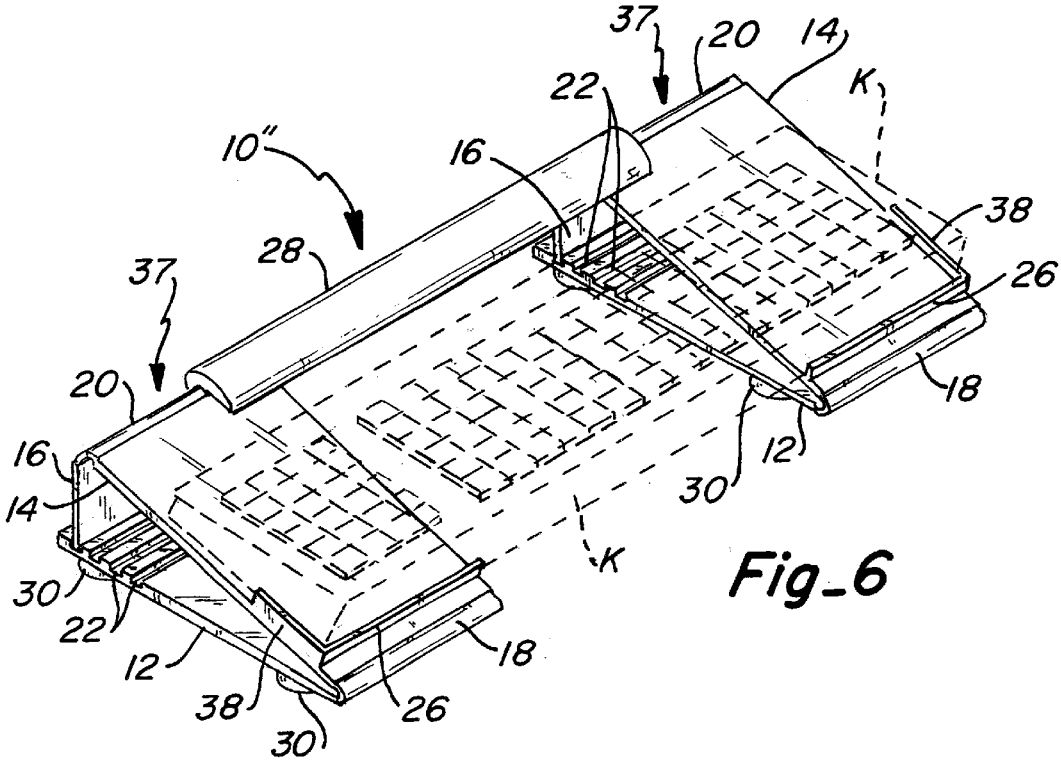
FIG. 6 is a perspective view of another modification of the first embodiment.

Another modification of the first embodiment appears in FIG. 6. As shown here, there are two separate keyboard elements 37 making up the keyboard support apparatus 10". Each of the keyboard support elements 37 are constructed in accordance with the design of keyboard support 10 shown in FIG. 1; however, the keyboard support elements are spaced from one another and work in cooperation to support a single keyboard. The apparatus 10" may further include a wrist pad 28 to stabilize the connection between the keyboard support elements 37. Lastly, each keyboard support element 37 may be provided with corresponding side supports 38 which further help to stabilize the keyboard K mounted thereon. When it is desired to dissemble the keyboard support apparatus 10", the wrist pad is removed, and each of the keyboard support elements 37 are folded in the same manner as described above with respect to the keyboard support apparatus 10.

Figure 7:
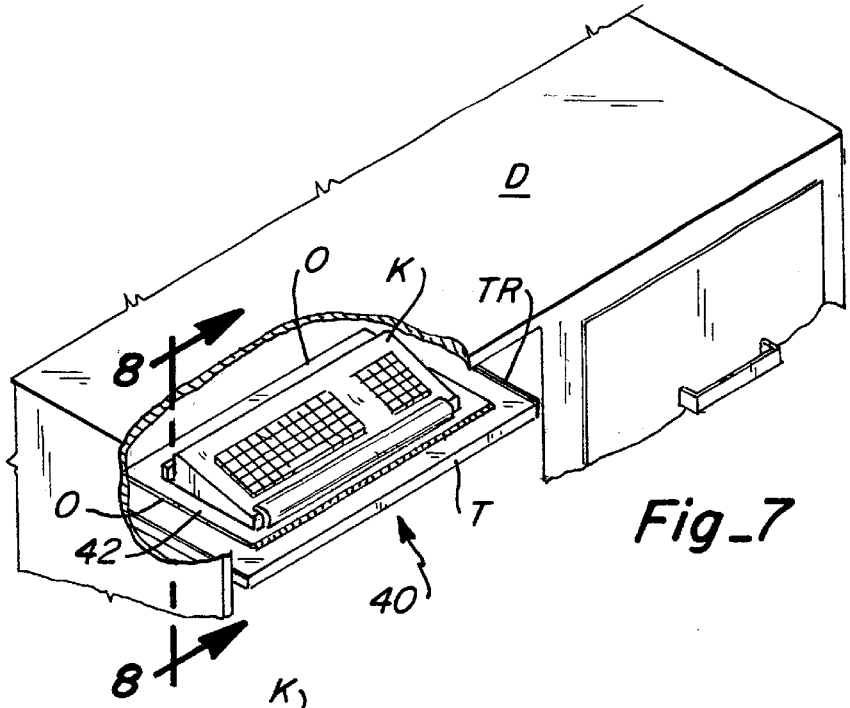
FIG. 7 is a fragmentary perspective view of a computer desk incorporating the second embodiment of the invention.

FIG. 7 illustrates a second embodiment of the invention which is keyboard support apparatus 40 used in conjunction with a computer desk D. The computer desk D includes a pull-out tray T which slides along tracks TR in a horizontal fashion. When the computer desk is in use, the pull-out tray is pulled out toward the operator exposing keyboard K. When it is desired to stow the keyboard, the pull-out tray is simply pushed back in, thus concealing keyboard K within the computer desk D.

Figure 8:
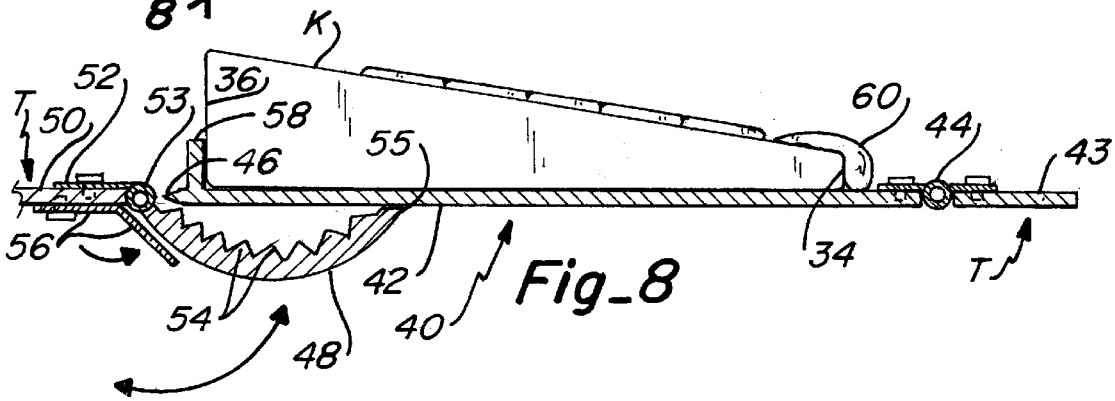
FIG. 8 is a vertical section, taken along line 8—8 of FIG. 7, illustrating the second embodiment of the invention.

The keyboard support apparatus 40 includes a base member 42 which is a panel secured within an opening such as a generally rectangular opening O cut out of tray T. As best seen in FIG. 7, base member 42 is secured at the front edge of opening O to the front portion 43 of the tray T as by a piano hinge 44. The rear or far edge 46 of base 42 is therefore free to rotate about hinge 44. An angle adjustment member 48 attaches at the rear edge of opening O to the rear portion 50 of pull-out tray T as by integral flange 52. Angle adjustment member 48 rotates around hinge 53. The angle adjustment member 48 has a plurality of interior facing adjustment slots 54. The rear or far edge 46 is placed in one of the adjustment slots 54 in order to position the base 42 at the desired reverse inclination. One way in which to achieve this is simply to gently push down on base 42 overcoming the upward force placed on angle adjustment member 48 by leaf spring 56 which attaches to the underside of rear portion 50. When the base 42 has been lowered to the desired reverse inclination, pressure on the base can be released and far edge 46 will then reside within one of the corresponding adjustment slots 54. In order to allow the base 42 to be returned to its horizontal position, the operator may reach underneath the tray T and rotate the free end 55 of angle adjustment 48 in a clockwise direction (according to the view of FIGS. 8 and 9). This will release the far edge 46 within the adjustment slot 54, in turn allowing the base 42 near rear edge 46 to rotate in a clockwise direction by the force from spring 56. A rear stop 58 may be formed on base 42 to prevent the keyboard K from sliding off of the tray T.

One angle adjustment member 48 may be used which is centered along the length of the rear edge 46. Alternatively, a pair of angle adjustment members 48 may be used with one member 48 placed adjacent opposite ends of the rear edge 46.

Figure 9:
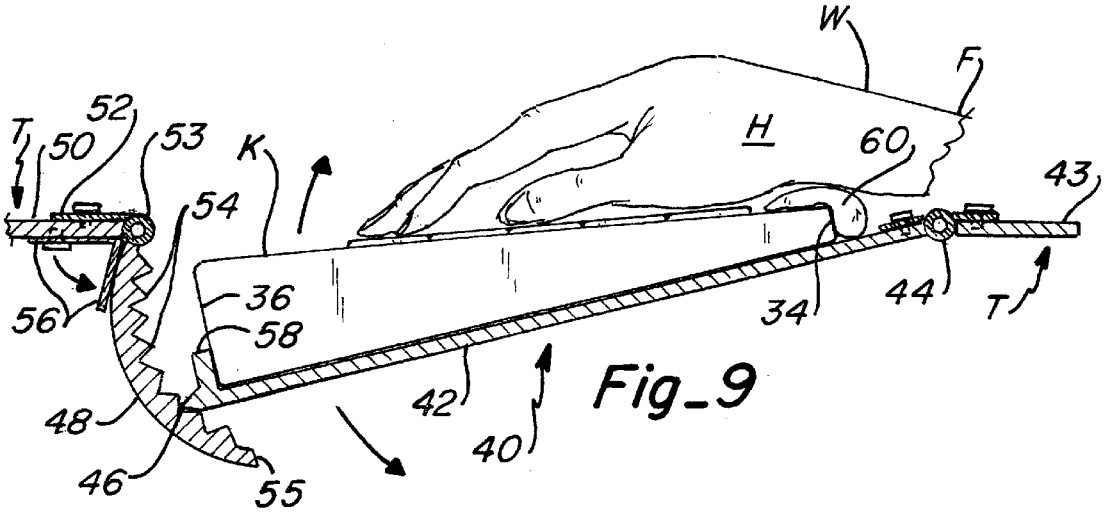
FIG. 9 is another vertical section, taken alone line 8—8 of FIG. 7, illustrating the second embodiment wherein the keyboard has been rotated to the desired reverse inclination.

FIG. 9 illustrates the keyboard support apparatus 40 rotated to a desired reverse inclination, and further showing an operator whose hands H are placed at a lower level as compared to the operator's forearms F. It shall be understood that the angle adjustment member 48 may be shaped to allow a wide range of reverse inclinations for the base member 42. FIG. 9 also illustrates the use of a wrist pad 60 which may be used to help support the wrist. Although the second embodiment is illustrated in conjunction with a pull-out tray, it should be understood that any desk or computer stand can be modified to provide an opening which incorporates the hinged base member 42 in combination with the angle adjustment member 48.

By the foregoing, a keyboard support apparatus is provided in two embodiments which can be used either when an operator has a need for a portable keyboard support, or for a more permanent keyboard support used with a standard computer desk or table. The first embodiment is extremely simple in construction, yet allows flexibility in the angle at which the operator desires to place the support in reverse inclination. The first embodiment also allows an operator to fold and store the apparatus in a compact manner. The second embodiment is also simple in construction, yet allows great flexibility for positioning a keyboard at the desired reverse inclination.

This invention has been described in detail with reference to particular embodiments thereof, but it will be understood that various other modifications can be effected within the spirit and scope of this invention.

What is claimed is:

1. A keyboard support apparatus for supporting a keyboard and a user's wrists during keyboard operations, said apparatus comprising:

a base panel including a plurality of adjustment slots formed thereon;

an inclined panel having first and second ends, said first end of said inclined panel rotatably connected to said base panel;

an adjustment panel having first and second ends, said first end of said adjustment panel being rotatably connected to said second end of said inclined panel to form a connection, said second end of said adjustment panel being selectively engageable with a desired one of said adjustment slots to vary the reverse inclination of said inclined panel with respect to said base panel, said inclined panel extending at an angle from said base panel at less than thirty degrees; and wherein the keyboard support apparatus enables a user's wrists to rest on said connection between said inclined panel and said adjustment panel.

2. An apparatus, as claimed in claim 1, further including:

a stop positioned at said first end of said inclined panel.

3. An apparatus, as claimed in claim 1, further including:

a non-slip surface bonded to said inclined panel.

4. An apparatus, claimed in claim 1, further including:

a wrist pad placed at said connection between said inclined panel and said adjustment panel.

5. An apparatus, as claimed in claim 1, wherein:

said inclined panel extends continuously under a keyboard mounted on said inclined panel.

6. A non-collapsible keyboard support apparatus for supporting a keyboard and a user's wrists during keyboard operations, said apparatus comprising:

base panel having first and second ends;

an inclined panel having first and second ends, said first end of said inclined panel connected to said first end of said base panel, said inclined panel being positioned at an angle of less than thirty degrees with respect to said base panel;

a positioning panel rigidly interconnecting said second end of said base panel to said second end of said inclined panel, said base panel, said inclined panel, and said positioning panel forming a triangular cross-sectional shape; and wherein the keyboard support apparatus enables a user's wrists to rest on said connection between said inclined panel and said positioning panel.

7. A keyboard support apparatus for supporting a keyboard and a user's wrists during keyboard operations, said apparatus comprising:

a base panel;

an inclined panel having first and second ends, said first end of said inclined panel rotatably connected to said base panel, and said inclined panel extending at an angle from said base panel at less than thirty degrees; and means for adjusting the inclination of the inclined panel with respect to said base panel, said means for adjusting interconnecting said second end of inclined panel to said base panel; and wherein the keyboard support apparatus enables a user's wrists to rest on said connection between said inclined panel and said means for adjusting.

8. An apparatus, as claimed in claim 7, further including:

a non-slip surface bonded to said inclined panel.

9. An apparatus, as claimed in claim 7, further including:

a wrist pad placed at said second end of said inclined panel for supporting wrists of a user.

10. An apparatus, as claimed in claim 7, further including:

a stop positioned at said first end of said inclined panel to prevent a keyboard mounted thereon from sliding off said inclined panel.

11. A method of reducing physical discomfort for a user of a keyboard, said method comprising:

(a) providing a keyboard support apparatus having (i) abase panel including a plurality of adjustment slots formed thereon;

(ii) an inclined panel having first and second ends, the first end of the inclined panel rotatably connected to the base panel;

(iii) an adjustment panel having first and second ends, the first end of the adjustment panel being rotatably connected to the second end of the inclined panel to form a connection, the second end of the adjustment panel being selectively engageable with a desired one of the adjustment slots to vary the reverse inclination of the inclined panel with respect to the base panel;

(b) positioning the keyboard support apparatus in front of the user;

(c) adjusting the keyboard support apparatus by placing the second end of the adjustment panel in the desired one of the adjustment slots on the base panel to adjust the reverse inclination of the inclined panel with respect to the base panel, the inclined panel being adjustable so that the inclined panel extends from said base panel at less than thirty degrees;

(d) placing a keyboard on the keyboard support apparatus;

(e) placing the user's wrists on the connection; and (f) using the keyboard in an inclined position.

* * * * *

UNITED STATES PATENT AND TRADEMARK OFFICE

CERTIFICATE OF CORRECTION

PATENT NO. : 6,543,949 B1 
DATED : April 8, 2003
INVENTOR(S) : Eugene B. Ritchey et al.

It is certified that error appears in the above-identified patent and that said Letters Patent is hereby corrected as shown below:

Column 6,
Line 20, insert -- a -- before "base".
Line 63, insert a space between "a" and "base".

Signed and Sealed this

Thirteenth Day of May, 2003

JAMES E. ROGAN
*Director of the United States Patent and Trademark Office*